United States Patent [19]

Wong

[11] 4,244,569

[45] Jan. 13, 1981

[54] BASKETBALL PRACTICING APPARATUS

[76] Inventor: James K. Wong, 46-194 Nona Loop, Kaneohe, Hi. 96744

[21] Appl. No.: 618,758

[22] Filed: Oct. 2, 1975

[51] Int. Cl.[3] ..... A63B 63/08

[52] U.S. Cl. ..... 273/1.5 A; 273/389; 273/392

[58] Field of Search ..... 273/1.5 R, 1.5 A, 105 R, 273/102 R, 26 A, 389, 392, 398–402

[56] References Cited

U.S. PATENT DOCUMENTS

| | | | |
|---|---|---|---|
| 1,628,364 | 5/1927 | Hiett | 273/1.5 R |
| 2,085,206 | 6/1937 | Holmdahl | 273/1.5 R |
| 2,534,067 | 12/1950 | Rubin | 273/1.5 R |
| 2,593,758 | 4/1952 | Holmdahl | 273/1.5 R |
| 2,964,316 | 12/1960 | Rose | 273/102 R X |
| 2,978,246 | 4/1961 | Van Groningen | 273/26 A |
| 3,011,784 | 12/1961 | Segretto | 273/26 A |
| 3,025,058 | 3/1962 | Brumfield | 273/1.5 R |
| 3,698,712 | 10/1972 | Pero | 273/26 A |

*Primary Examiner*—Paul E. Shapiro
*Attorney, Agent, or Firm*—Freilich, Hornbaker, Wasserman, Rosen & Fernandez

[57] ABSTRACT

Apparatus for improving the accuracy of shooting a basketball, including a target such as a brightly-colored ball and apparatus extending below the basketball hoop for holding the target at the center of the hoop, the holding apparatus permitting the target to be easily deflected to allow a basketball to fall through the hoop.

5 Claims, 5 Drawing Figures

BASKETBALL PRACTICING APPARATUS

BACKGROUND OF THE INVENTION

This invention relates to an aid for improving the accuracy of throwing a basketball into a basketball hoop.

Basketball players often attempt to increase their "shooting" or throwing accuracy during practice, by concentrating on a particular spot and throwing the ball at that spot. For example, they may be instructed by their coach to concentrate on and to throw at the back of the hoop. However, any such target is usually useful only for one position of the player, such as directly in front of the basket. Also, some of the player's concentration may be lost in trying to see a particular spot which does not "stand out."

SUMMARY OF THE INVENTION

In accordance with one embodiment of the present invention, a basketball practice aid is provided which serves as an easily viewed small area towards which a basketball can be thrown from any direction, the practice aid avoiding interference with the normal path of a basketball when thrown to fall into the basket directly or upon bouncing off the backboard or rim, or when thrown so it does not fall through the basket. The apparatus includes a target, as in the form of a small colorful ball, and a target support which extends under the hoop of the basket and which holds the target ball at the center of the hoop. The target support includes a target-holding member which has a pivotally mounted inner end that allows the target ball to deflect downwardly and out of the way of a basketball which is falling through the basket, but which is resiliently biased toward a position at which the target ball is at the center of the hoop. This is accomplished by a coil spring which has an inner end fixed to a mount, an outer end fixed to the target-holding member, and a free middle portion which can bend.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
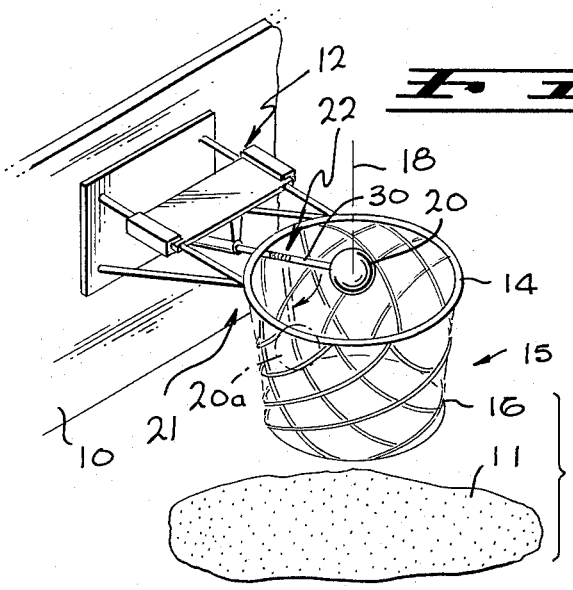
FIG. 1 is a perspective view of a basket installation, with a practice apparatus constructed in accordance with the present invention installed thereon.

As shown in FIGS. 1-5, a typical basket installation includes a backboard 10 mounted several feet above the floor 11 of a court and forming a support for a basketball hoop, a hoop-mounting bracket 12 with an inner end mounted on the backboard, and a basket 15 which includes a hoop 14 mounted on the outer end of the bracket and a net 16 depending from the hoop. It is helpful in practicing "shooting" of the basketball, for the player to concentrate on a particular small spot and to thrust the basketball to reach that spot. The hoop 14 itself is too large to serve as an adequate target. A player can try to concentrate on the outer end of the bracket 12 which lies opposite the backboard, but it is sometimes difficult to concentrate on the end of the bracket because it does not "stand out." Furthermore, such a target cannot be easily used when the player is at the side of the basket instead of directly in front of it. A target could easily be positioned along the axis 18 of the hoop, but a simple mounting of a target thereat could interfere with play by preventing a basketball from descending through the hoop. Furthermore, any device for holding such a target could interfere with the normal flight of a basketball, where the ball bounces off an area of the backboard or hoop near the brasket 12, to fall either through the hoop or away from it. It is desirable that there be no interference with the normal path of a basketball even when it does not pass down through the hoop, since the players must try to predict where the ball will fall in order to catch or hit it.

In accordance with the present invention, a target 20 and a target support or holder 22 are provided, wherein the holder supports the target on the vertical axis 18 of the hoop without interfering with the normal course of the basketball in bouncing off the backboard or hoop or in descending through the basket. The target 20 is a brightly colored ball, which may be formed, for example, of foamed plastic or rubber. The holder 22 includes a mount 24 which is attached to the hoop-mounting bracket 12 and which has an outer end 26 extending to a position substantially immediately below the hoop 14 of the basket, a tightly coiled spring 28 extending from the outer end of the mount, and an elongated target-holding member or rod 30 extending from the spring 28 to the target 20. The target ball 20 is threadably attached to the outer end of the rod, to permit changing to a smaller target ball for advanced players. When a basketball, indicated at 32, begins to descend through the hoop 14 and presses down on the target 20, the spring 28 serves as a pivot joint that can pivot to the configuration indicated at **28*a* to permit the target to deflect to the position 20*a* wherein it is out of the way of the basketball and permits the basketball to fall down through the hoop and net of the basket. When the basketball has passed down through the basket, the spring 28 returns the rod 30 and target ball 20 to its original position. Thus, the tightly coiled spring 28 with the coils normally pressing on one another, serves as a pivot joint that permits the target-holding rod to pivot down out of the way of a basketball, serves as a spring that pivots the rod back up again, and serves as a stop that holds the rod at its original position wherein the target 20 is at a predetermined height along the axis 18** of the basket.

In order to prevent interference with normal movement of a ball that bounces off the backboard (where a backboard is present in the basketball practice installation) or hoop, the holder 22 is constructed to extend downwardly from the bracket 12 where it is out of the way of a basketball. Thus, the mount 24 includes a clamp 34 which clamps onto the hoop-holding bracket 12 of the basket assembly, a flange 36 that extends downwardly from the clamp, a tube 37 fixed to the lower end of the flange, and a pole 38 that extends forward from the tube to the spring. Thus, all portions of the mount 24 lie below the level of the hoop 14, except for a portion of the clamp 34. The clamp 34 lies on a portion of the bracket 12 that is close to the backboard, and therefore which cannot be contacted by the large diameter basketball. The end of the rod at the mount outer end 26 lies under the hoop 14. A standard basketball hoop has a diameter of 18 inches, and therefore the distance between the inner end of the rod and the center of the ball is approximately 9 inches.

When a ball descends through the basket, and the spring and rod pivot to the positions 28*a*, 30*a*, the spring and rod should contact the net 16 lightly or not at all, to prevent the net from hampering downward pivoting of the rod and to prevent the spring and rod from injuring the net. To assure this, at least the outer end of the spring, and preferably the middle too, should lie within the net 16, or in other words, forward of a position under the hoop 14. This is why the outer end 26 of the mount extends to a position substantially under the hoop 14. The outer end 26 of the mount is preferably of a smaller diameter than the openings of the net 16 so that even if the holder is adjusted forward or backward in positioning the target ball 20, there will be no interference by the net in forward and rearward movement of the outer end of the holder.

Figure 3:
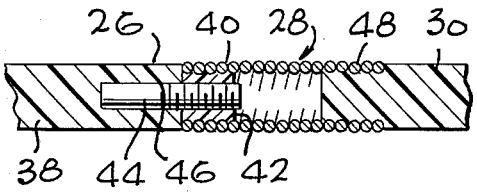
FIG. 3 is a sectional view of a portion of the apparatus of FIG. 2.
Figure 2:
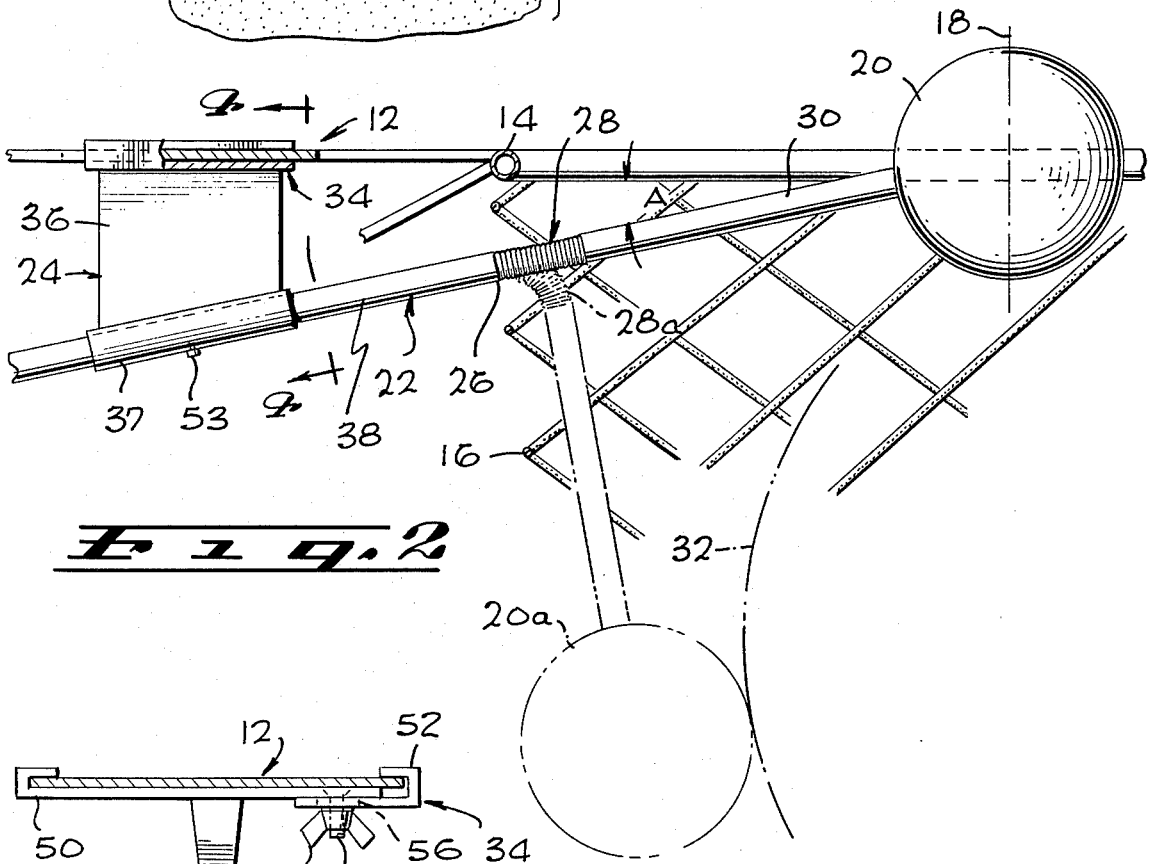
FIG. 2 is a partial side view of the practice apparatus of FIG. 1.

As illustrated in FIG. 3, the spring 28 has a considerable middle portion which is free of obstruction against bending. The inner end 40 of the spring is forcefully threaded onto a cap 42 which has a projecting screw 44 which is threadably received in a hole 46 at the end of the mount 24 in the pole 38 thereof. The outer end 48 of the spring is tightly threaded onto an inner end of the rod 30.

Figure 4:
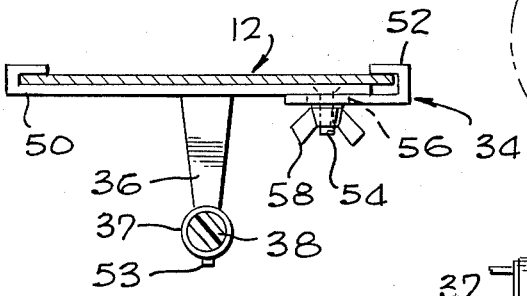
FIG. 4 is a view taken on the line 4—3 of FIG. 2.
Figure 5:
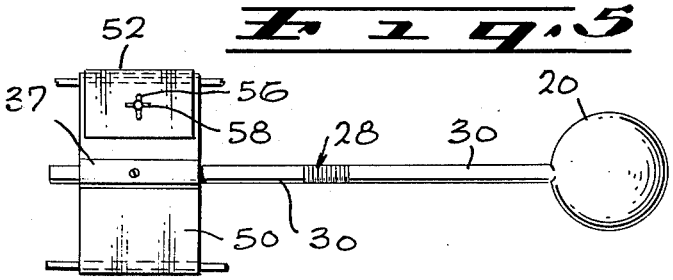
FIG. 5 is a bottom view of the apparatus of FIG. 2.

As illustrated in FIGS. 4 and 5, the clamp 34 includes two members 50, 52 which lie under the hoop-holding bracket 12, except for end portions that encircle the edges of the bracket. A stud 54 has an upper end fixed to one of the members 50 and extends through a slot 56 in the other member 52. A wing nut 58 is threaded onto the stud to hold the two clamp members 50, 52 close together. When the wing nut 58 is loosened, the two clamp members 50, 52 can be slid along the hoop-holding bracket 12, or the members can be slid apart for removal or attachment to the bracket 12.

In order to install the target apparatus, a person first unscrews the stud 44 at the inner end of the spring from the outer end 26 of the mount. He then installs the clamp 34 on the hoop-holding bracket 12 by loosening the wing nut 58, placing the clamp members on the underside of the bracket 12, sliding the members 50, 52 together, and tightening the wing nut. The outer end 26 of the mount should then lie substantially below the hoop 14. The installer then installs the rod 30 with the spring 28 at its inner end onto the mount, by projecting the stud 44 on the spring through the net 16 and into the outer end 26 of the mount, and then screwing the stud 44 into the holder. If the target ball 20 is not positioned at the axis 18 of the basket, the wing nut 58 can be loosened and the clamp shifted forward or rearwardly and retightened.

The target apparatus is preferably positioned with the target ball 20 not only lying on the axis 18 of the basket, but also at approximately the level of the top of the basket at the level of the horizontal hoop 14. This is accomplished even though the outer end of the mount 24 lies below the hoop 14, by constructing the holder so that when the rod and spring are attached thereto, the rod extends at an upward incline, at the angle A, so that the target ball lies at the desired height. If the target is too low, a setscrew 53 threaded into the pole-holding tube 37 can be loosened and the pole slid forward to move the target forward and upward. The clamp 34 then can be slid back until the target lies on the axis of the hoop, but at a greater height. A greater amount of vertical adjustment can be provided by constructing the flange 36 to provide a larger angle A, so that coaches who desire to position the target higher than the top of the hoop 14 can do so.

Thus, the invention provides a target apparatus with a target that can be easily seen, and with a target supporting apparatus or holder which normally holds the ball on the axis of the basket and preferably near the top of the basket, but which avoids interference with normal ball movement either when the ball bounces off the hoop or backboard or when the ball falls through the basket. This is accomplished by a target holding apparatus which normally holds the target at a predetermined position on the axis of the hoop while permitting the target to easily deflect out of the way of a basketball descending through the hoop. The target supporting apparatus includes a portion which extends through the basket but under the hoop to avoid interference with normal ball movement when bouncing off the hoop. A coil spring with a portion lying substantially directly under the hoop, provides a pivot joint that permits the downward pivoting of a target-holding member, while also biasing the member to pivot back towards its initial position, and serving as a stop to prevent the rod from pivoting past its initial position. A target supporting apparatus also can be constructed which mounts on the hoop of the basketball installation, instead of on the hoop support bracket.

Although particular embodiments of the invention have been described and illustrated herein, it is recognized that modifications and variations may readily occur to those skilled in the art and consequently it is intended that the claims be interpreted to cover such modifications and equivalents.

What is claimed is:

1. In combination with a basketball hoop installation which includes a hoop, a net depending from the hoop, a backboard, and a hoop-mounting bracket extending from said backboard and supporting said hoop a distance from the backboard, the improvement of a basketball practice aid comprising:

a target;

a rod having an outer end coupled to said target and an inner end;

a mount having an inner portion mounting on the basketball hoop installation, said mount having an outer portion; and a tightly coiled spring having an inner end mounted on said outer mount portion, an outer end mounted on said rod inner end, and a free middle portion which can bend enough to permit the rod to pivot approximately 90°;

said mount outer end lying below the level of said hoop and said rod being held so it extends at an upward incline to hold said target at least at the level of said hoop.

2. The combination described in claim 1 wherein:

said target is in the form of a brightly colored ball, centered on the axis of the hoop, whereby to provide an easily seen target that can be aimed at.

3. In combination with a basketball hoop installation which includes a backboard and a hoop spaced from the backboard so a basketball can bounce off the rear of the hoop, the improvement of a basketball practice aid, comprising:

a target;

a rod having an outer end coupled to said target and an inner end;

a mount having an inner end portion mounting on the basketball hoop installation; and means coupling the inner end of said rod to said mount, said means forming a pivot joint which allows said rod to pivot but which biases said rod toward a predetermined orientation;

said mount outer end lying below the level of said hoop, and said coupling means biasing said rod toward an orientation wherein said rod extends at an upward incline to hold said target near the level of said hoop.

4. The combination described in claim 3 wherein:

said target is a brightly colored ball centered on the axis of the hoop.

5. Apparatus for use with a basketball hoop installation which includes a basketball hoop of 18 inch diameter mounted with its axis extending vertically and which can include a net depending from the hoop, to improve the shooting accuracy of a basketball player, comprising:

a brightly colored ball;

a mount for attachment to a basketball hoop installation, said mount having an outer end for lying under the basketball hoop;

a rod having an inner end privotally connected to said mount outer end, and an outer rod end connected to said ball, said mount formed to hold the rod so it extends at an upward incline when the mount is fastened to the basketball hoop installation;

The distance between said rod inner end and the middle of said ball being approximately 9 inches, whereby the rod can hold the ball on the axis of the hoop but can pivot out of the way of a ball passing down through the hoop and net.

* * * * *